US009668629B2

(12) United States Patent
Hyun et al.

(10) Patent No.: US 9,668,629 B2
(45) Date of Patent: Jun. 6, 2017

(54) VACUUM CLEANER

(71) Applicant: LG ELECTRONICS INC., Seoul (KR)

(72) Inventors: Kietak Hyun, Seoul (KR); Goondong Park, Seoul (KR); Seungyeop Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 376 days.

(21) Appl. No.: 14/516,821

(22) Filed: Oct. 17, 2014

(65) Prior Publication Data

US 2015/0107047 A1 Apr. 23, 2015

(30) Foreign Application Priority Data

Oct. 18, 2013 (KR) ..... 10-2013-0124469

(51) Int. Cl.
*A47L 9/10* (2006.01)
*A47L 9/14* (2006.01)

(52) U.S. Cl.
CPC ..... *A47L 9/108* (2013.01); *A47L 9/149* (2013.01)

(58) Field of Classification Search
CPC ..... A47L 9/20; A47L 9/1691; A47L 9/108; A47L 7/0038; A47L 9/102; A47L 9/149
See application file for complete search history.

(56) References Cited

U.S. PATENT DOCUMENTS

2009/0255083 A1* 10/2009 Hwang ..... A47L 9/108 15/347
2012/0180253 A1* 7/2012 Hwang ..... A47L 9/108 15/339

FOREIGN PATENT DOCUMENTS

| | | | |
|---|---|---|---|
| EP | 1 839 758 | A1 | 10/2007 |
| JP | S50-15767 | U | 2/1975 |
| JP | S54-114359 | U | 8/1979 |
| KR | 10-2007-0102465 | A | 10/2007 |
| KR | 10-0992221 | B1 | 10/2010 |
| KR | 10-1052170 | B1 | 7/2011 |
| KR | 10-1052183 | B1 | 7/2011 |
| KR | 10-1072638 | B1 | 10/2011 |

OTHER PUBLICATIONS

European Search Report issued in related Application No. 14188645.7 dated Feb. 23, 2015.
Korean Notice of Allowance issued in related Application No. 10-2013-0124469 dated Apr. 30, 2015 (No English translation attached).

* cited by examiner

*Primary Examiner* — Robert Scruggs
(74) *Attorney, Agent, or Firm* — Ked & Associates, LLP

(57) ABSTRACT

Provided is a vacuum cleaner. The vacuum cleaner includes a cleaner body and a dust container separably mounted on the cleaner body. The dust container includes a dust collection body including a first chamber in which air and dust are separated from each other and a second chamber in which the dust separated in the first chamber are stored and a pressing member rotatably reciprocated between the first and second chambers within the dust collection body to compress the dust stored in the second chamber in one direction while moving from the first chamber to the second chamber.

19 Claims, 9 Drawing Sheets

VACUUM CLEANER

CROSS-REFERENCE TO RELATED APPLICATIONS

The present application claims priority under 35 U.S.C. 119 and 35 U.S.C. 365 to Korean Patent Application No. 10-2013-0124469 filed on Oct. 18, 2013, which is hereby incorporated by reference in its entirety.

BACKGROUND

1. Field

In general, vacuum cleaners are devices that suction air containing dust by using a vacuum pressure generated by a suction motor mounted in a main body to filter the dust within the main body.

Such a vacuum cleaner may be mainly classified into a canister type vacuum cleaner in which a suction nozzle is provided separately with respect to a main body and connected to the main body by using a connection tube and an upright type vacuum cleaner in which a suction nozzle is coupled to a main body.

2. Background

A vacuum cleaner is disclosed in Korean Patent Registration No. 1072638 that is a prior document. The vacuum cleaner includes a cleaner body and a dust container that is separably mounted on the cleaner body.

A rotatable pressing member and a fixed member that is maintained in stopped state may be provided in the dust container. Also, the pressing member may bidirectionally rotate to compress dust disposed on both sides of the fixed member.

In the vacuum cleaner according to the related art, since the dust disposed at both sides of the fixed member are compressed, when the dust drop to a side opposite to the fixed member with respect to a rotation shaft of the pressing member, the dust disposed at both side of the fixed member may be uniformly compressed. However, if the dust eccentrically drop toward one side, a dust empty signal may be frequently generated.

Also, since a dust separation part is separately provided with respect to the dust container, spaces in which the dust container and the dust separation part are separately provided are required.

SUMMARY

Embodiments provide a vacuum cleaner in which space availability and dust collection efficiency are improved.

In one embodiment, a vacuum cleaner may include: a cleaner body; and a dust container separably mounted on the cleaner body, wherein the dust container includes: a dust collection body including a first chamber in which air and dust are separated from each other and a second chamber in which the dust separated in the first chamber are stored; and a pressing member rotatably reciprocated between the first and second chambers within the dust collection body to compress the dust stored in the second chamber in one direction while moving from the first chamber to the second chamber.

In another embodiment, a vacuum cleaner may include: a cleaner body; and a dust container separably mounted on the cleaner body, wherein the dust container includes: a dust separation part; a second dust storage part disposed under the dust separation part; a first dust storage part in which the dust in the second dust storage part are introduced, the first dust storage part being partitioned from the dust separation part and the second dust storage part; and a pressing member rotatably reciprocated between the first and second dust storage parts to allow the dust stored in the first dust storage part to move into the second dust storage part, thereby compressing the dust stored in the second dust storage part.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
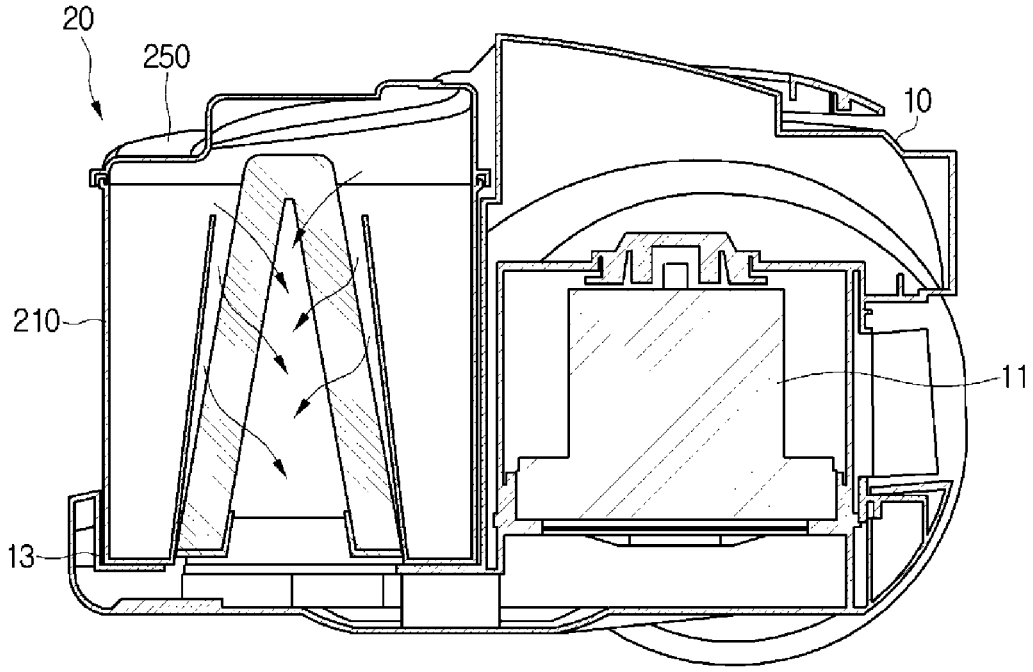
FIG. 1 is a schematic cross-sectional view of a vacuum cleaner according to an embodiment.
Figure 2:
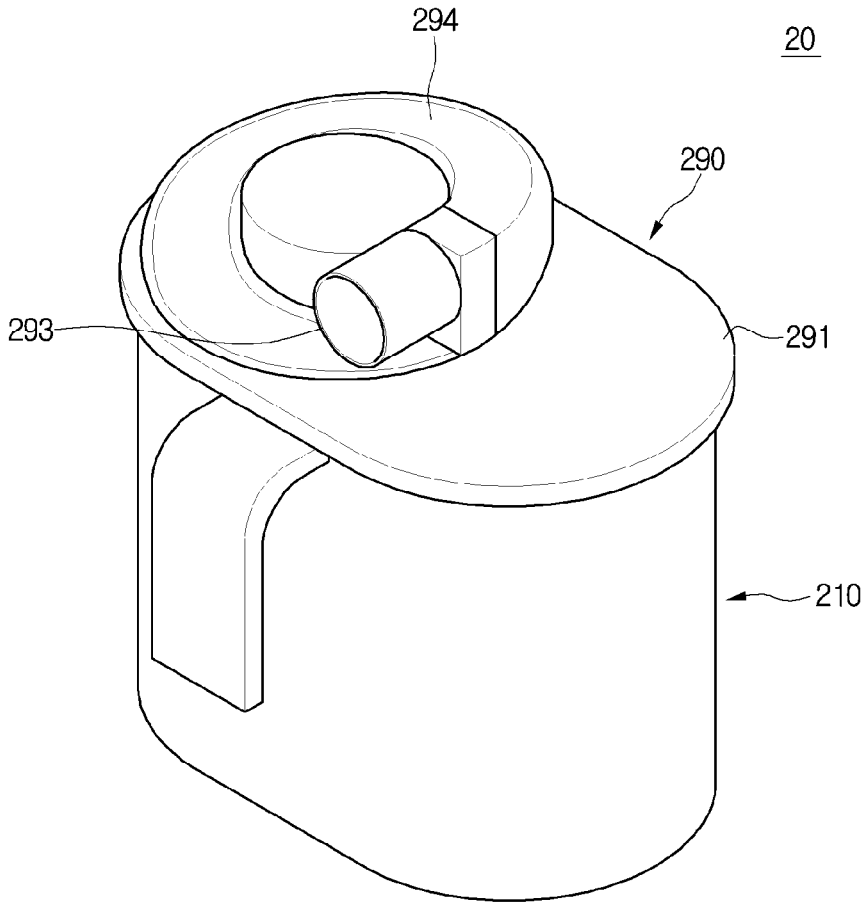
FIG. 2 is a schematic perspective view of a dust container according to an embodiment.

FIG. 1 is a schematic cross-sectional view of a vacuum cleaner according to a first embodiment, and FIG. 2 is a schematic perspective view of a dust container according to the first embodiment.

Hereinafter, although a canister type vacuum cleaner is described as an example, the idea of the current embodiment may be equally applied to an upright type vacuum cleaner or a robot cleaner.

Referring to FIGS. 1 and 2, a vacuum cleaner 1 according to the current embodiment may include a cleaner body 10 including a suction motor 11 and a dust container 20 separably mounted on the cleaner body 10. The dust container 20 may be mounted on a mounting part 13 provided in the cleaner body 10.

In the current embodiment, the dust container 20 may perform a dust separation function for suctioning air containing dust to separate the dust from the air and a dust storage function for the dust separated from the air. That is, the dust container 20 includes a dust separation part and a dust storage part.

Alternatively, the vacuum cleaner according to the current embodiment may include only the dust container 20 for separating or storing dust or may further include an additional dust separation part or dust container at an upper or lower side thereof.

The dust container 20 may include a dust collection body 210 for separating and storing dust and a cover 290 for covering one side of the dust collection body 210. For example, the dust collection body 210 may have an upper opening. The cover 290 may cover the upper opening of the dust collection body 210. Also, when the cover 290 is separated from the dust collection body 210, the dust stored in the duct collection body 210 may be discharged to the outside through the upper opening.

The cover 290 may include a cover body 291 covering the dust collection body 210, a suction hole 293 through which the air containing the dust is suctioned, and a flow guide 294 through which the dust and air suctioned through the suction hole 293 flow and are guided into the dust collection body 210. The flow guide 294 may protrude upward from the cover body 291 to guide the dust and air suctioned through the suction hole 293 so that the dust and air flow in a spiral shape.

Hereinafter, the dust container 20 will be described in more detail.

Figure 3:
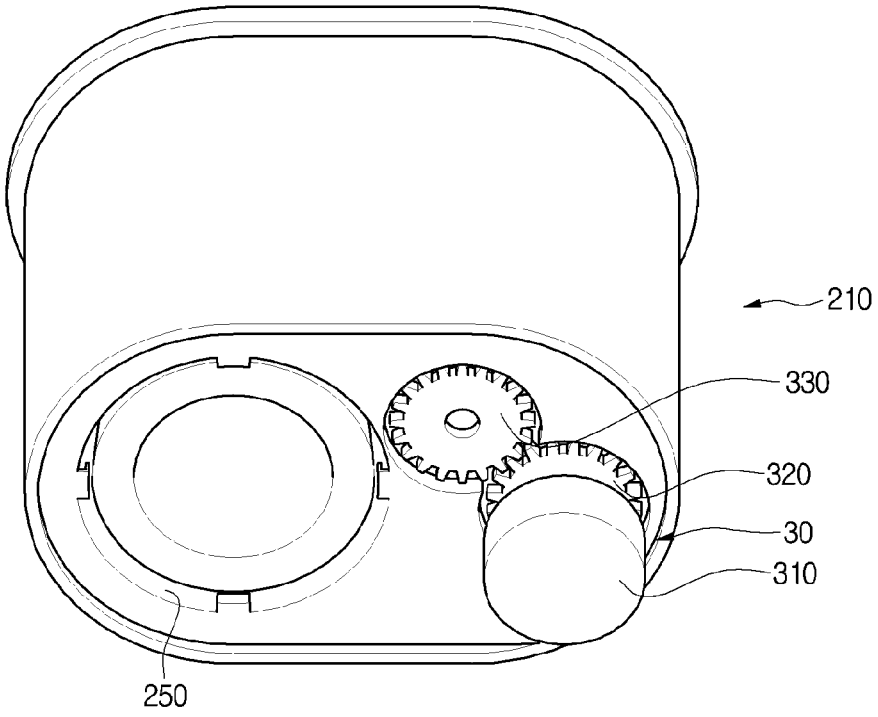
FIG. 3 is a lower perspective view of the dust container according to an embodiment.
Figure 4:
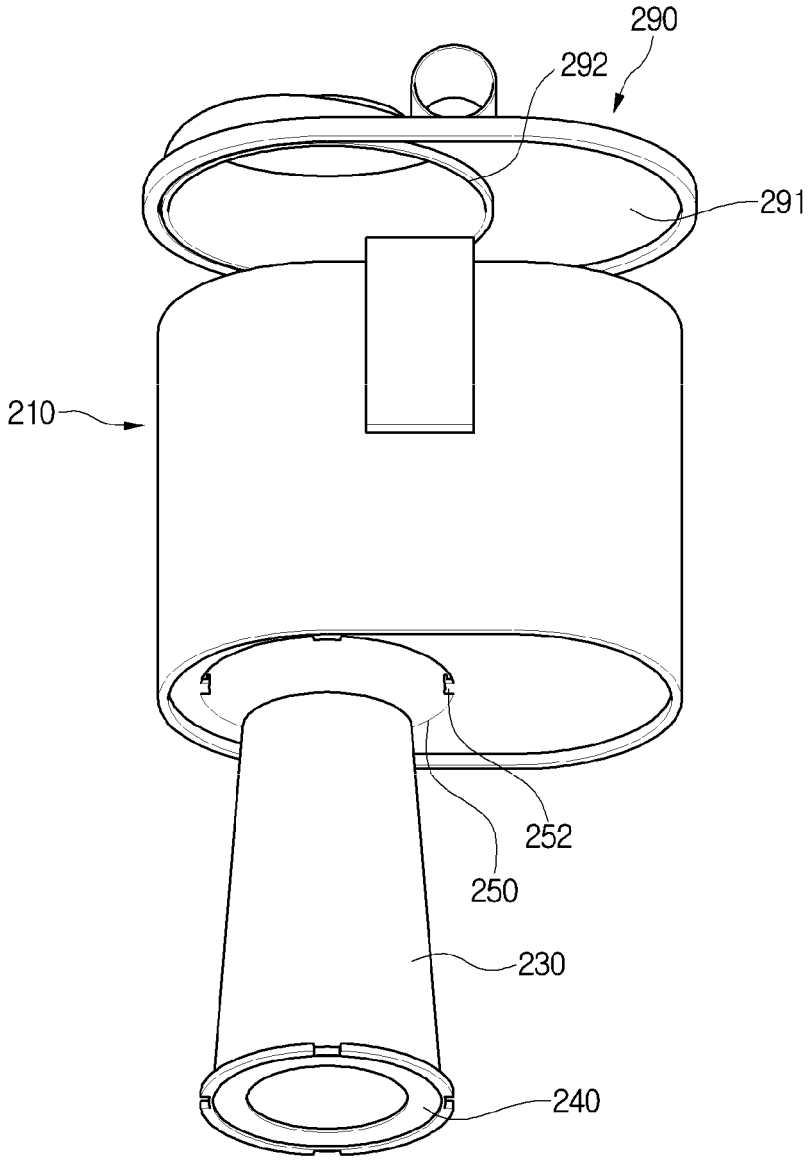
FIG. 4 is an exploded perspective view of the dust container according to an embodiment.
Figure 5:
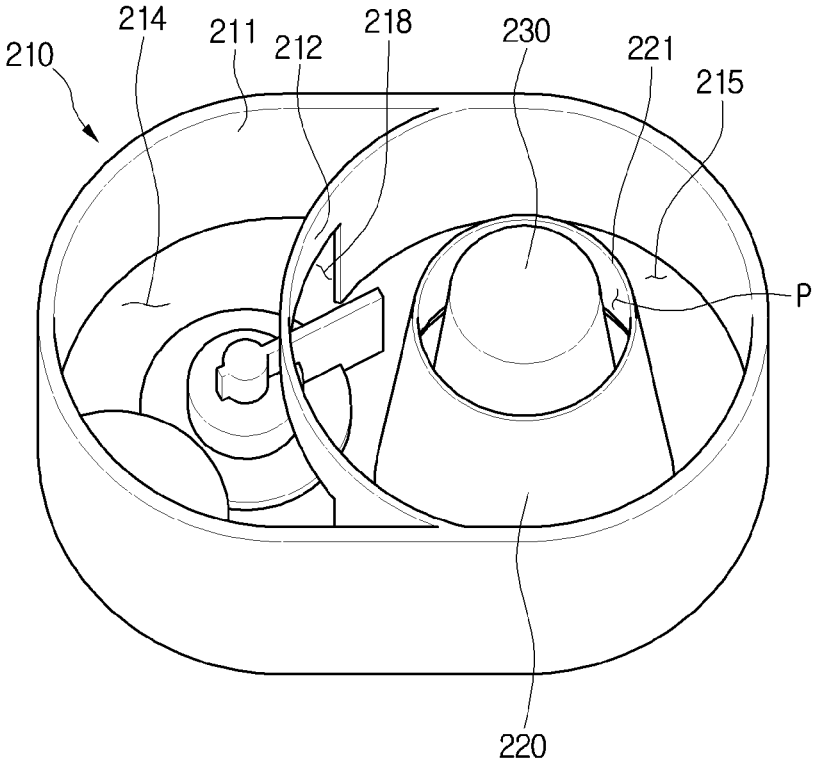
FIG. 5 is a perspective view of a dust collection body according to an embodiment.
Figure 6:
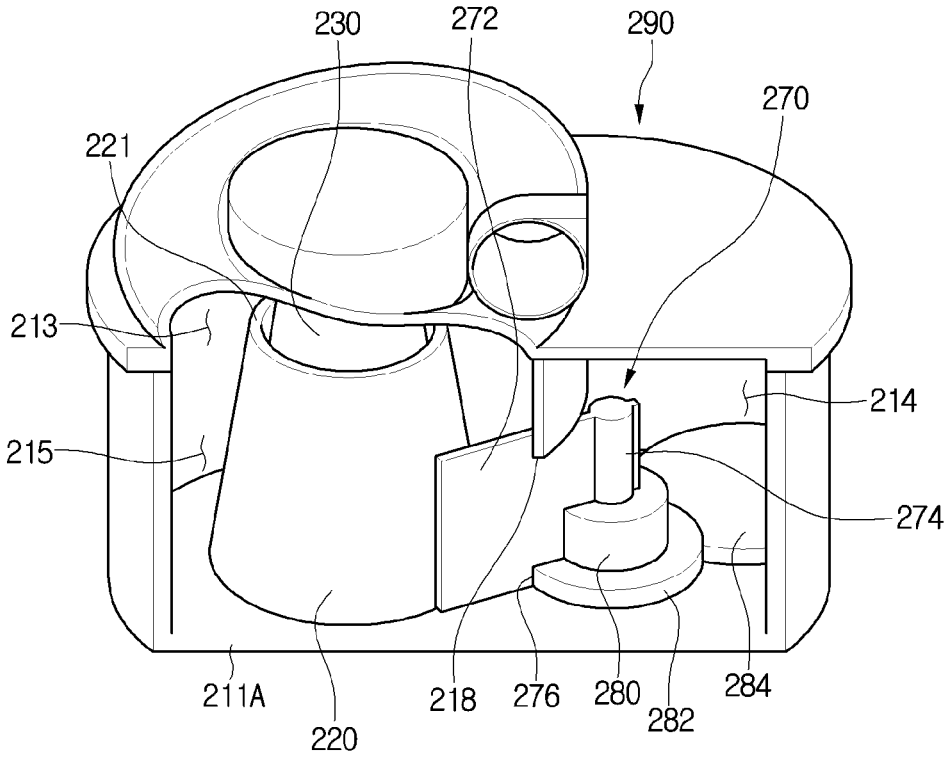
FIG. 6 is a cross-sectional view of the dust container according to an embodiment.
Figure 7:
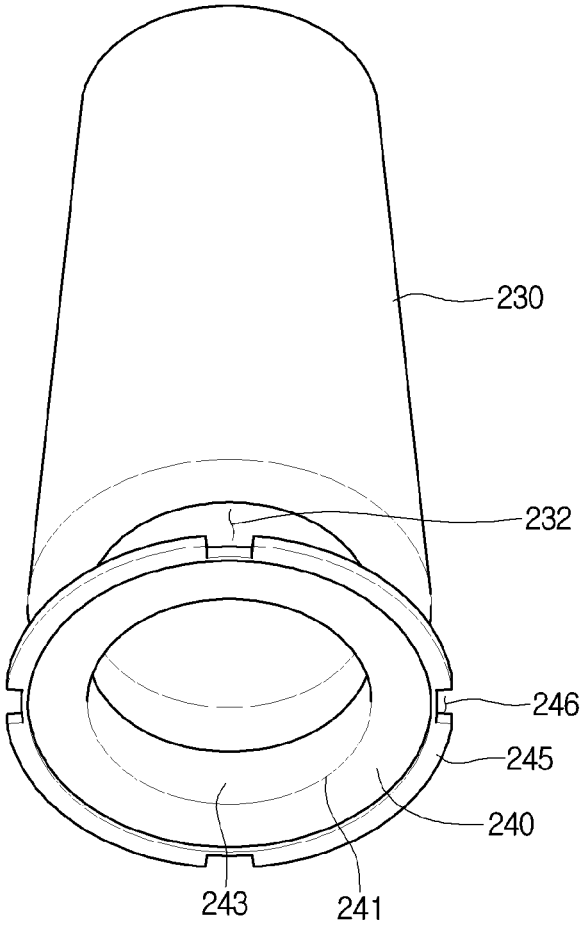
FIG. 7 is a perspective view of a filter and a filter support.

FIG. 3 is a lower perspective view of the dust container according to the first embodiment, FIG. 4 is an exploded perspective view of the dust container according to the first embodiment, FIG. 5 is a perspective view of the duct collection body according to the first embodiment, FIG. 6 is a longitudinal cross-sectional view of the dust container according to the first embodiment, and FIG. 7 is a perspective view of a filter and a filter supporter.

Referring to FIGS. 3 to 7, the dust collection body 210 according to the current embodiment may include a first wall 211, a second wall 212 partitioning an inner space of the first wall 211 into a plurality of spaces, and a bottom wall 211A.

The first wall 211 may have a non-circular shape. For example, although the first wall 211 has an oval shape, the current embodiment is not limited thereto. The second wall 212 may partition the inner space of the first wall 211 into a first dust storage part 214 and a second dust storage part 215.

A portion of an inner circumference surface of the first wall 211 and one surface of the second wall 212 may define the first dust storage part 214. The other portion of the inner circumferential surface of the first wall 211 and the other surface of the second wall 212 may define the second dust storage part 215.

For example, the second dust storage part 215 may have a circular shape, and the first dust storage part 214 may have a non-circular shape. The first dust storage part 214 may be disposed outside the second dust storage part 215.

The other portion of the inner circumferential surface of the first wall 211 and the other surface of the second wall 212 may additionally define the dust separation part 213. That is, the dust separation part 213 and the second dust storage part 215 may be disposed in the same space, and the dust separation part 213 may be disposed above the second dust storage part 215. The dust separation part 213, the first dust storage part 214, and the second dust storage part 215 may be referred to herein as respective sections, regions, areas, or portions of the dust collection body 210.

A hole 292 having a shape corresponding to that of the dust separation part 213 may be defined in the cover body 291. The dust and air spirally flowing along the flow guide 294 of the cover body 291 may be introduced into the dust separation part 213 through the hole 292.

Here, the air discharged from the flow guide 294 may spirally flow along the inner circumferential surface of the dust separation part 213 to generate a cyclone flow within the dust separation part 213.

A communication hole 218 for allowing the second dust storage part 215 to communicate with the first dust storage part 214 may be defined in the second wall 212. The communication hole 218 may be defined upward from a lower end of the second wall 212 up to a predetermined height. Here, the communication hole 218 may have a height less than about ⅔ of the total height of the second wall 212. This is done for separating the dust and air at an upper portion of the second wall 212.

In another aspect, the dust collection body 210 may include a main wall having a cylindrical shape to define the second dust storage part 215 and an auxiliary wall surrounding a portion of the main wall to define the first dust storage part 214. In this case, the communication hole 218 may be defined in the main wall.

Thus, according to the current embodiment, the dust separated from the air by the dust separation part 213 may flow downward toward the second dust storage part 215 to flow into the first dust storage part 214 through the communication hole 218.

The dust collection body 210 may further include an air guide 220 for guiding the discharge of the air separated from the dust. The air guide 220 may extend upward from the bottom wall 211A of the dust collection body 210. The air guide 220 may be integrated with the bottom wall 211A or may be separably coupled to the bottom wall 211A.

The air guide 220 has an inflow hole 221. The air separated from the dust in the dust separation part 213 may be introduced into the air guide 220 through the inflow hole 221.

The air guide 220 may have a truncated cone or cylindrical shape with a hollow. Here, the air guide 220 and the dust separation part 213 or the second dust storage part 215 may have the same center.

An opening 250 through which the air is discharged may be defined in the bottom wall 211A of the dust collection body 210. The air guide 220 may extend upward from the periphery of the bottom wall 211A having the opening 250. Also, the air guide 220 is spaced apart from the first wall 211 and the second wall 212.

Thus, the air guide 220 may prevent the dust (or the air or air containing the dust) flowing into the second dust storage part 215 from being discharged to the outside of the dust collection body 210 through the opening 250.

Substantially, the air and the dust are separated in an outer region of the air guide 220, and then the air separated from dust may flow through the air guide 220 and the separated dust may fall into the second dust storage part 215. Since the air guide 220 is provided in the dust separation part 213, the cyclone flow may be smoothly generated within the dust separation part 213.

The air guide 220 may have a height less than that of the dust collection body 210. Thus, the air separated from the dust in the dust separation part 213 may be easily introduced into the air guide 220.

A filter 230 for filtering the air separated from the dust may be accommodated in the air guide 220. The current embodiment is not limited to a kind of filter 230, for example, a pre filter or sponge type filter.

The filter 230 may have a cylindrical or truncated cone shape. For example, when the air guide 220 has the cylindrical shape, the filter 230 may have the cylindrical shape. On the other hand, when the air guide 220 has the truncated cone shape, the filter 230 may have the truncated cone shape. Alternatively, the filter 230 may have the truncated cone shape, and the air guide 220 may have the cylindrical shape, and vice versa.

The filter 230 may be inserted into the air guide 220 through the opening 230 from the outside of the dust collection body 210. In the state where the filter 230 is inserted into the air guide 220, at least one portion of an outer surface of the filter 230 may be spaced apart from an inner surface of the air guide 220. Thus, an air passage P through which the air introduced into the air guide 220 through the inflow hole 221 flows may be defined between the outer surface of the filter 230 and the inner surface of the air guide 220.

Here, when the air passage P is viewed from an upper side of the air guide 220, the air passage P may have a circular ring shape.

The air passage P may have a passage cross-sectional area that gradually decreases downward from an upper portion of the air guide 220 or is uniform.

According to the current embodiment, since the air passage P is defined between the outer surface of the filter 230 and the inner surface of the air guide 220, the air introduced into the air guide 220 may not flow into an upper portion of the filter 230 and also may flow downward along the air passage P to pass through a lower portion of the filter 230.

Thus, the air may substantially pass through an entire surface of the filter 230. According to the current embodiment, since a surface area of the filter 230 contacting the air increase, filtering performance may be improved.

Also, since the filter 230 increases in surface area, and the air passes through the entire surface of the filter 230, the phenomenon in which a portion of the filter 230 is blocked may be prevented to reduce the cleaning number of filter 230. Also, the filter 230 may be improved in performance and used for a long time.

To reduce the passage loss by the filter 230, the filter 230 may have a hollow 232, and an upper side of the filter 230 may be covered. Thus, the air passing through the filter 230 may flow into the hollow 232 to pass through the opening 250 of the bottom wall 211A. The hollow 232 may have a truncated cone or cylindrical shape.

The filter 230 accommodated in the air guide 220 may have an upper end passing through the inflow hole 221 of the air guide. In the state where the filter 230 is accommodated in the air guide 220, the upper end of the filter 230 may be disposed at the same height as that of an upper end of the air guide 220 or disposed higher than the upper end of the air guide 220. Alternatively, the filter 230 may have a height equal to or greater than that of the air guide 220.

If the filter 230 has a height greater than that of the air guide 220, the upper end of the filter 230 accommodated in the air guide 220 may be disposed at a height equal to or greater than that of the upper end of the duct collection body 210. Alternatively, the filter 230 may have a height equal to or greater than that of the duct collection body 210. Thus, the upper end of the filter 230 may be disposed in the flow guide 294 of the cover 290.

A portion of the air within the dust separation part 213 may pass through the filter 230 at the outside of the air guide 220, and the other portion of the air may be introduced into the air passage P within the air guide 220 to pass through the filter 230.

When the cover 290 is separated from the duct collection body 210, a portion of the upper portion of the filter 230 may be directly exposed to the outside.

According to the current embodiment, when the user separates the cover 290 from the dust collection body 210 to empty the dust storage parts 214 and 215 containing the dust, the upper portion of the filter 230 may be directly exposed to the outside. Thus, the user may confirm a state of the upper portion of the filter 230 through a naked eye thereof to easily determine whether the cleaning of the filter 230 is required.

In the current embodiment, to allow the user to confirm the upper portion of the filter 230, the filter 230 may have a height equal to or greater than that of the air guide 220. On the other hand, even though the filter has a height less than that of the air guide 220, the user may confirm the state of the filter 230 through the inflow hole 221 of the air guide 220.

The filter 230 may be supported by a filter supporter 240. The filter supporter 240 may include a support rib 243 inserted into the hollow 232 of the filter 230 and a discharge hole 241 through which the air passing through the filter 230 is discharged.

The support rib 243 extends upward from a top surface of the filter supporter 240. The support rib 243 may contact an inner surface of the filter 230 in a state where the support rib 243 is inserted into the hollow 232 of the filter 230. Thus, in the state where the filter 230 is supported by the filter supporter 240, it may prevent the filter 230 from being easily separated from the filter supporter 240. Alternatively, the support rib 243 may be spaced apart from the inner surface of the filter 230.

A plurality of coupling ribs 245 coupled to the dust collection body 210 may be disposed around the filter supporter 240. The plurality of coupling ribs 245 may be disposed along a circumferential direction of the filter supporter 240 and spaced apart from each other. Thus, a hole 246 may be defined between the plurality of coupling ribs 245.

A plurality of hook part 252 coupled to the filter supporter 240 may be disposed on the bottom wall 211A of the duct collection body 210. The plurality of hook parts 252 may be horizontally spaced apart from each other.

To couple the filter supporter 240 to the duct collection body 210, the hole 246 of the filter supporter 240 and the hook part 252 of the duct collection body 210 may be aligned with each other. In this state, the filter 230 supported by the filter supporter 240 may be accommodated into the air guide 220. Then, the hook part 252 may pass through the hole 246 of the filter supporter 240. In this state, when the filter supporter 240 rotates at a predetermined angle, the hook part 252 may be hooked on the coupling rib 245.

When the filter supporter 240 is coupled to the duct collection body 210, the filter supporter 240 covers the opening 250 of the duct collection body 210.

In the current embodiment, a bottom surface of the filter 230 contacts a top surface of the filter supporter 240. Here, the air within the air passage P may not substantially horizontally pass through the filter 230, but may pass in a downwardly inclined direction from the outer surface of the filter 230 toward the inner surface of the filter 230 (see FIG. 1).

Thus, the filter 230 is compressed downward by a pressure of the air passing through the filter 230, and the bottom surface of the filter 230 is closely attached to the top surface of the filter supporter 240 to prevent the air from leaking between the bottom surface of the filter 230 and the top surface of the filter supporter 240.

Referring to FIGS. 3, 5, and 6, the dust container 20 may further include a pressing member for compressing the dust stored in the first dust storage part 214.

The pressing member 270 may rotate by a driving device to compress the dust stored in stored in the first dust storage part 214.

The pressing member 270 may include a rotation shaft 274 and a pressing plate 272 coupled to the rotation shaft 274 or integrated with the rotation shaft 274. Here, the pressing plate 272 may have a height less than the communication hole 218 of the second wall 212. Thus, the pressing plate 272 may pass through the communication hole 218.

A shaft guide 280 in which the rotation shaft 274 is inserted may be disposed on the bottom wall 211A of the dust collection body 210. The shaft guide 280 may protrude upward from the bottom wall 211A. The shaft guide 280 may have a cylindrical shape with a hollow. A portion of the rotation shaft 274 may be inserted into the shaft guide 280 from an upper side of the shaft guide 280.

The driving device 30 may include a compression motor, a driving gear 320 connected to the compression motor 310, and a driven gear 330 engaged with the driving gear 320 and connected to the rotation shaft of the pressing member 270.

The compression motor 310 may be a bidirectionally rotatable motor, for example, a synchronous motor or a step motor. The compression motor 310 may be disposed on the cleaner body 10 by a motor mount (not shown). Hereinafter, the synchronous motor that is provided as an example of the compression motor 310 will be described. Thus, when an external force having a predetermined intensity or more is applied to the compression motor 310 in a direction opposite to a rotation direction of the compression motor 310, the compression motor 310 may automatically change in rotation direction.

A shaft of the driven gear 330 may be inserted into the shaft guide 280 from a lower side of the dust collection body 210 and then be coupled to the rotation shaft 274 of the pressing member 270.

In the current embodiment, when the dust container 20 is separated from the cleaner body 10, the mounted state of the compression motor 310 and the driving gear 320 on the cleaner body 10 may be maintained, and the driven gear 30 together with the dust container 20 may be firstly separated from the cleaner body 10.

Although the rotation force of the compression motor 310 is transmitted into the rotation shaft 274 of the pressing member 270 through the plurality of gears in the current embodiment, the present disclosure is not limited thereto. For example, the compression motor 310 may be directly coupled to the rotation shaft 274 of the pressing member 270, or the rotation force of the compression motor 310 may be transmitted into the rotation shaft 274 of the pressing member 270 through a single gear.

First and second accommodation parts 282 and 284 in which the driven gear 330 and the driving gear 320 are accommodated may be disposed on the bottom wall 211A of the duct collection body 210. For example, the first and second accommodation parts 282 and 284 may be a protrusion formed to protrude upward from the bottom wall 211A.

Thus, a cutoff part 276 (or cut-out portion) for preventing the pressing plate 272 from interfering with the first accommodation part 282 while the pressing plate 272 rotates may be defined on a lower portion of the pressing plate 272.

At least one portion of the rotation shaft 274 of the pressing member 270 may be disposed in the communication hole 218 of the second wall 212 so that the pressing member 270 compresses the dust stored in the first dust storage part 214. Thus, since the pressing plate 272 increases in horizontal width, a compression area for compressing the dust stored in the first dust storage part 214 may increase.

However, a rotation center point (see reference symbol C of FIG. 8) of the rotation shaft 274 may be defined in the first dust storage part 214. In this case, the horizontal width of the pressing plate 272 may be secured, and also, the interference with the second wall 212 having the communication hole 218 may be prevented.

A cyclone flow axis in the dust separation part and a rotation center line of the rotation shaft 274 may be parallel to each other and also be horizontally spaced apart from each other. Thus, a flow of air existing in the second dust storage part 215 may have a less influence on the dust compressed in the first dust storage part 214.

Hereinafter, a dust separation process and dust compression process in the dust container according to the current embodiment will be described.

Figure 8:
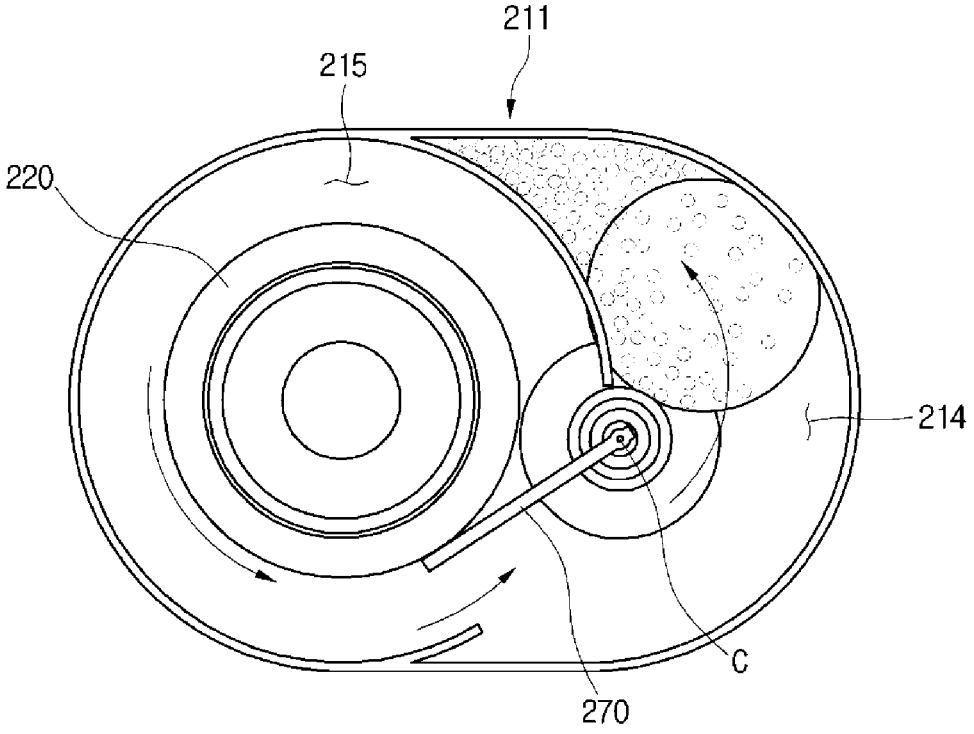
FIG. 8 is a view of a state in which a pressing plate is disposed in a second dust storage part according to an embodiment.
Figure 9:
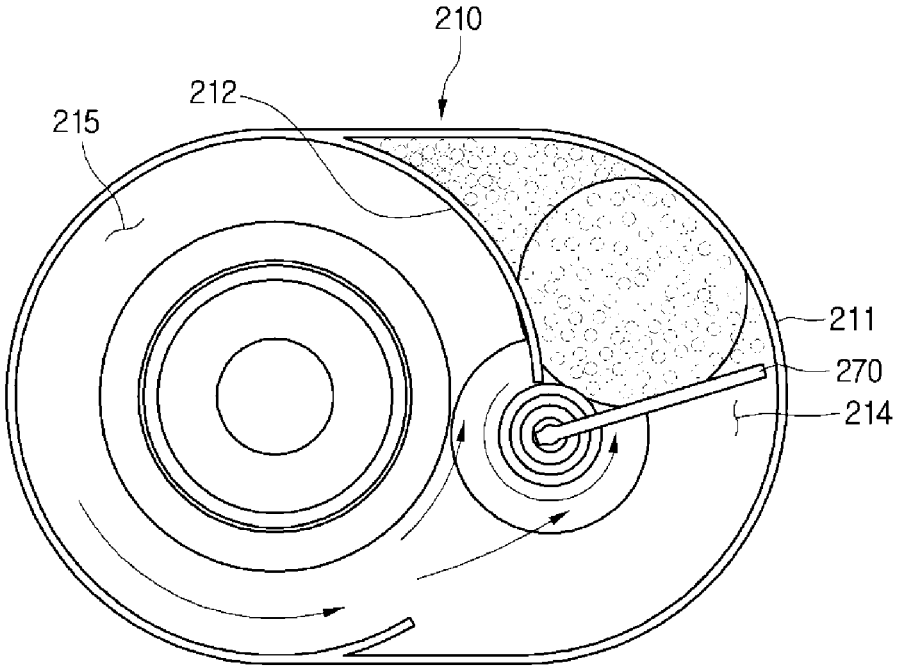
FIG. 9 is a view of a state in which the pressing plate compresses dust in the first dust storage part according to an embodiment.

FIG. 8 is a view of a state in which a pressing plate is disposed in a second dust storage part according to the first embodiment, and FIG. 9 is a view of a state in which the pressing plate compresses dust in the first dust storage part according to the first embodiment.

Referring to FIGS. 1 to 9, when a power button of the vacuum cleaner 1 is selected, or an operation signal is inputted, the suction motor 11 may operate to generate a suction force. Dust and air may be introduced into the cleaner body 10 by the generated suction force. Then, the dust and air introduced into the cleaner body 10 may be introduced into the dust container 20 through the suction hole 293.

The dust and air introduced into the dust container 20 may flow along the flow guide 294 and then be introduced into the dust collection body 210. That is, the dust and air flowing along the flow guide 294 may be introduced into the dust separation part 215. The dust and air may be separated from each other while spirally flowing along an inner circumferential surface of the dust separation part 215.

A portion of the air separated from the dust may directly pass through the filter 230 at the outside of the air guide 220, and the other portion of the air may be introduced into the air passage P within the air guide 220 through the inflow hole 221 to pass through the filter 230. Then, the air passing through the filter 230 may be discharged to the outside of the dust container 20 through the discharge hole 241 of the filter supporter 240.

The dust separated from the air may move from the second dust storage part 215 and be stored in the first dust storage part 214 through the communication hole 218 of the second wall 212.

While the suction motor 11 operates, a power may be applied to the compression motor 310. Although the compression motor 310 is interlocked with the operation of the suction motor in the current embodiment, the present disclosure is not limited thereto. For example, the compression motor 310 may operate when a compression mode is selected by an input part (not shown), or the compression motor 310 may be intermittently automatically turned on or off while the suction motor 11 operates. The current embodiment is not limited to an operation time of the compression motor 310.

When a power is applied to the compression motor 310, the rotation force of the compression motor 310 may be transmitted into the driving gear 320 and the driven gear 330, and thus the pressing member 270 may rotate. The pressing member 270 may be reciprocated and rotate between a position of FIG. 8 (hereinafter, referred to as a "first position") and a position of FIG. 9 (hereinafter, referred to as a "second position").

As illustrated in FIG. 8, while the pressing member 300 rotates in one direction (a clockwise direction in FIG. 8), the pressing member 300 may pass through the communication hole 218 to contact the air guide 220. Thus, the air guide 220 may apply a resistance force to the pressing member 270 in a direction opposite to the rotation direction of the pressing member 270. As a result, the resistance force may be transmitted into the compression motor 310 through the gears 320 and 330, and the compression motor 310 may change in rotation direction.

In the current embodiment, a portion of the air guide 220 that is in contact with the pressing member 270 may be called a first contact part.

Thus, in the current embodiment, a portion of the pressing member may move from the first dust storage part 214 to the second dust storage part 215 while the pressing member 270 rotates.

While the pressing member 270 is disposed in the second dust storage part 215, the dust spirally flowing within the second dust storage part 215 may be guided by the pressing member 270 to move to the first dust storage part 214.

Since the compression motor 310 changes in rotation direction, the pressing member 270 may rotate in the other direction (a counterclockwise direction in FIG. 9). Thus, the pressing member 270 may pass through the communication hole 218 to move from the second dust storage part 215 to the first dust storage part 214. Here, while the pressing member 270 moves from the second dust storage part 215 to the first dust storage part 214, the pressing member 270 may allow the dust piles up on the bottom of the second dust storage part 215 to move to the first dust storage part 214.

When the pressing member 270 continuously rotates in the other direction, a region defined by the pressing member 270 and the first and second walls 211 and 212 within the second dust storage part 214 may decrease to compress the dust within the region by using the pressing member 270.

While the pressing member 270 rotates in the other direction, the pressing plate 272 may contact the second accommodation part 284. Thus, the second accommodation part 284 may apply a resistance force (an external force) to the pressing member 270 in a direction opposite to the rotation direction of the pressing member 270. As a result, the resistance force may be transmitted into the compression motor 310 through the gears 320 and 330, and the compression motor may change in rotation direction. Thus, the pressing member 270 may rotate again in the one direction.

In the current embodiment, a portion of the second accommodation part 284 that is in contact with the pressing member 270 may be called a second contact part.

For another example, the first and second accommodation parts 282 and 284 may be omitted. In this case, the second contact part contacting the pressing member 270 may be disposed on the bottom wall 211A or the first wall 211. Alternatively, the first and second accommodation parts 282 and 284 may be omitted. In this case, the first wall 211 itself may serve as the second contact part.

According to the current embodiment, since the dust stored in the first storage part 214 is compressed, the dust collection performance of the dust container may be improved, and the number for emptying the dust container containing the dust out may be reduced.

For another example, if the compression motor is the step motor, the rotation direction of the compression motor may change by a control part (not shown). In this case, the control part may acquire the rotation number when the compression motor rotates and then change the rotation direction of the compression motor on the basis of the rotation number.

In this case, the pressing member 270 may change in direction before contacting the first and second contact parts.

According to the current embodiment, since the dust stored in the first storage part 214 is compressed, the dust collection performance of the dust container may be improved, and the number for emptying the dust container containing the dust out may be reduced.

Also, since the first dust storage part that is partitioned from the dust separation part is disposed in the dust collection body, and the pressing member compresses the dust stored in the first dust storage part, the constitutions for separating and storing dust may be reduced in volume to improve space availability.

Also, since the pressing member compresses the dust stored in the first dust storage part in only one direction, the dust may be sufficiently compressed to store the dust in the whole first dust storage part, thereby improving the dust collection efficiency.

Although a space that is defined under the dust separation part is defined as the second dust storage part in the foregoing embodiment, the present disclosure is not limited thereto. For example, one space of the dust separation part may be defined as the second dust storage part. That is, a space defined by the first wall may be the dust separation part.

Thus, in this specification, the dust separation part and the second dust storage part may be called a first chamber, and the first dust storage part may be called a second chamber.

An additional embodiment is proposed.

Although the suction hole and the air guide are provided in the cover in the foregoing embodiments, the current embodiment is not limited thereto. For example, the suction hole may be defined in the dust collection body 210. In this case, the suction hole may be defined in the upper portion of the first wall constituting the dust separation part.

Also, although the dust separation part and the second dust storage part are defined by the first and second walls in the forgoing embodiments, the current embodiment is not limited thereto. For example, the second dust storage part may be defined by the first and second walls, and the dust separation part having a cylindrical shape may be provided as a separate part and then be accommodated into a space defined by the first and second walls. In this case, an upper portion of each of the air guide and the filter may be accommodated into the dust separation part.

Although the dust collection body includes the first and second dust storage parts in the foregoing embodiments, the current embodiment is not limited thereto. For example, the dust collection body may include only the second dust storage part. In this case, the dust collection body may be defined by only the first wall, and the second wall having the communication hole may be omitted.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a cleaner body; and a dust container separably mounted on the cleaner body, wherein the dust container includes a dust collection body including a first chamber configured to separate dust from air flowing in the first chamber and a second chamber configured to store the dust separated in the first chamber; and a pressing member provided to rotate in a reciprocating manner between the first and second chambers within the dust collection body and configured to move the dust from the first chamber to the second chamber, wherein the dust collection body includes a partition wall that partitions the first chamber from the second chamber, and a communication hole provided in the partition wall between the first and second chambers, wherein the pressing member is configured to move between the first and second chambers through the communication hole.

2. The vacuum cleaner according to claim 1, wherein the second chamber includes a first dust storage area, and the first chamber includes a dust separation area and a second dust storage area disposed under the dust separation area, wherein dust in the second dust storage area is moved to the first dust storage area.

3. The vacuum cleaner according to claim 2, wherein the pressing member rotates about a prescribed axis to extend a prescribed distance into the second dust storage area and to rotate from the second dust storage area into the first dust storage area to push and compress the dust from the second dust storage area into the first dust storage area.

4. The vacuum cleaner according to claim 1, wherein the pressing member includes a rotation shaft and a pressing plate which extends from the rotation shaft, at least a portion of the rotation shaft being disposed in the communication hole.

5. The vacuum cleaner according to claim 4, wherein a center of rotation of the rotation shaft is defined in the second chamber.

6. The vacuum cleaner according to claim 4, wherein an axis of rotation of the rotation shaft is parallel to a cyclone flow axis in the first chamber.

7. The vacuum cleaner according to claim 1, wherein the dust collection body includes a main wall that defines the first chamber, an auxiliary wall that defines the second chamber together with the main wall, and a communication hole provided in the main wall to allow the first and second chambers to communicate with each other, wherein the pressing member is configured to pass through the communication hole.

8. The vacuum cleaner according to claim 1, further comprising a compression motor to drive the pressing member, wherein the compression motor includes a bi-directionally rotatable motor, and when an external force is applied to the compression motor through the pressing member, the compression motor is configured to change a direction of rotation, and wherein first and second contact surfaces for applying the external force to the pressing member are disposed in the first and second chambers, respectively.

9. The vacuum cleaner according to claim 8, wherein an air guide to guide discharge of the air separated from the dust is disposed in the first chamber, and wherein the first contact surface is a surface of the air guide.

10. The vacuum cleaner according to claim 8, wherein the dust collection body includes a protrusion formed in the second chamber to accommodate at least one gear coupled between the compression motor and the pressing member, and wherein the second contact surface is a surface of the protrusion in the second chamber.

11. The vacuum cleaner according to claim 8, wherein the dust collection body includes a protrusion formed to accommodate at least one gear that transfers power from the compression motor to the pressing member, and the pressing member has a prescribed shape corresponding to a shape of the protrusion to prevent interference between the protrusion and the pressing member.

12. The vacuum cleaner according to claim 8, wherein the second contact surface is a portion of a wall that defines the dust collection body.

13. The vacuum cleaner according to claim 1, wherein an opening through which the air separated from the dust is exhausted is defined in a lower region of the first chamber.

14. A vacuum cleaner comprising:

a cleaner body; and a dust container separably mounted on the cleaner body, wherein the dust container includes a dust separation section, a second dust storage section disposed under the dust separation section, a first dust storage section for storing dust moved from the second dust storage section, the first dust storage section being partitioned from the dust separation section and the second dust storage section, a pressing member configured to rotatably reciprocate between the first and second dust storage sections to move the dust stored in the second dust storage section into the first dust storage section and to compress the dust stored in the first dust storage section, and a communication hole provided between the second dust storage section and the first dust storage section, wherein the pressing member is configured to pass through the communication hole.

15. The vacuum cleaner according to claim 14, wherein the pressing member includes a rotation shaft and a pressing plate that extends from the rotation shaft, and at least a portion of the rotation shaft being disposed in the communication hole.

16. The vacuum cleaner according to claim 15, wherein the pressing plate is disposed lower than an upper end of the communication hole.

17. The vacuum cleaner according to claim 14, wherein an air guide is provided to exhaust the air separated from the dust in the dust separation section, the air guide disposed in the second dust storage section, and when the pressing member rotates to contact the air guide, the pressing member is configured to change a direction of rotation.

18. The vacuum cleaner according to claim 14, wherein, when the pressing member contacts a wall defining the first dust storage section, the pressing member is configured to change a direction of rotation.

19. A vacuum cleaner comprising:

a cleaner body; and a dust container separably mounted on the cleaner body, wherein the dust container includes a dust collection body including a first chamber configured to separate dust from air flowing in the first chamber and a second chamber configured to store the dust separated in the first chamber; and a pressing member provided to rotate in a reciprocating manner between the first and second chambers within the dust collection body and configured to move the dust from the first chamber to the second chamber, and wherein the dust collection body includes a main wall that defines the first chamber, an auxiliary wall that defines the second chamber together with the main wall, and a communication hole provided in the main wall to allow the first and second chambers to communicate with each other, wherein the pressing member is configured to pass through the communication hole.

* * * * *